United States Patent [19]

Okamoto et al.

[11] Patent Number: 4,963,735

[45] Date of Patent: Oct. 16, 1990

[54] PLASMA SOURCE MASS SPECTROMETER

[75] Inventors: Yukio Okamoto, Sagamihara; Tsutomu Komoda, Tokyo; Satoshi Shimura; Seiichi Murayama, both Kokubunji; Masataka Koga, Katsuta, all of Japan

[73] Assignee: Hitachi, Ltd., Tokyo, Japan

[21] Appl. No.: 432,895

[22] Filed: Nov. 7, 1989

[30] Foreign Application Priority Data

Nov. 11, 1988 [JP] Japan ..... 63-283602
Feb. 3, 1989 [JP] Japan ..... 01-023835

[51] Int. Cl.[5] ..... H01J 49/12
[52] U.S. Cl. ..... 250/288; 250/281
[58] Field of Search ..... 250/288, 288 A, 281, 250/282

[56] References Cited

U.S. PATENT DOCUMENTS 4,287,419 9/1981 Booth ..... 250/396 ML

OTHER PUBLICATIONS

Olivares et al., Analytical Chemistry, 57, 13 (1985), pp. 2674–2679.

Date et al., Analyst, vol. 108, Feb. 1983, pp. 159–165.

*Primary Examiner*—Jack I. Berman

*Attorney, Agent, or Firm*—Antonelli, Terry, Stout & Kraus

[57] ABSTRACT

A plasma source mass spectrometer in which ions in a plasma generated in a high pressure (≦1 atm) region are introduced into a low pressure (≦$10^{-5}$ Torr) region to analysis the ion mass includes a moderate pressure (≧$10^{-3}$ Torr) region which is provided between the high pressure region and the low pressure region. The plasma generated in the high pressure region is diffused to the moderate pressure region in order to produce a diffused plasma. Ions are extracted from the diffused plasma by an ion extraction electrode having an ion extraction opening. In the vicinity of the ion extraction opening a convex-shaped toward the diffused plasma whereby ion sheath is formed, whereby the ions can be extracted toward the low pressure region with a high efficiency.

14 Claims, 5 Drawing Sheets

PLASMA SOURCE MASS SPECTROMETER

BACKGROUND OF THE INVENTION

The present invention relates to improvement of a plasma source mass spectrometer used for quantitative analysis of trace elements in materials or biological fields, and more particularly to improvement of ion extraction means for extracting ions from a plasma generated in a high pressure region.

The conventional plasma source mass spectrometry has been discussed in Anal. Chem., 57, 13 (1985) pp. 2674–2679, Analyst, 108 (February 1983) pp. 159–165, Bunseki, 7 (1985) pp. 505–508, etc. The fundamental construction of the conventional plasma source mass spectrometer is shown in FIG. 2*a* and the details of a portion A in FIG. 2*a* is shown by FIG. 2*b*. In FIG. 2*b*, reference numeral 10 designates a discharge tube, numeral 20 an inlet for plasma gas, numeral 30 an inlet for sample, numeral 40 an RF (or radio frequency) power supply coil, numeral 50 a plasma, numeral 60 an ion extraction electrode, numeral 61 an aperture provided in the ion extraction electrode 60, numeral 70 a skimmer, numeral 71 an aperture provided in the skimmer 70, numeral 80 an ion extraction lens, numeral 90 an ion beam, and numeral 100 a photon stopper (or baffle). Also, (i) represents a high pressure ($\sim$1 atm) region, (ii) a moderate pressure ($\sim$1 Torr) region, and (iii) a low pressure ($\leqq 10^{-4}$ Torr) region.

In the above-mentioned prior art, no sufficient consideration is paid to the improvement on the efficiency of extraction of ions (sample ions) 90 from the plasma 50 generated in the high pressure (atmospheric pressure) region (i). Therefore, a problem exists in respect of the detection limit (or sensitivity). Also, in order to suppress the deterioration of the S/N ratio of signal (S) to noise (N) caused by intrusion of photons from the plasma into an ion detector, the photon stopper 100 is provided on the axis of the ion beam 90, thereby preventing the photons from entering into the mass analyser side. Therefore, there is a problem that the ion lens system has a complicated construction as shown in FIG. 2*a*.

SUMMARY OF THE INVENTION

A first object of the present invention is to provide a plasma source mass spectrometer capable of improving the efficiency of extraction of ions from an atmospheric pressure plasma.

A second object of the present invention is to provide a plasma source mass spectrometer capable of effectively preventing the deterioration of S/N ratio which may be caused by photons from an atmospheric pressure plasma.

According to a first aspect of the present invention for achieving the above-mentioned first object, as shown in FIG. 1, a high pressure plasma 50 generated in a high pressure (760 to 1 Torr) region (i) is diffused (or expanded) into a moderate pressure (1 to $10^{-3}$ Torr) region (ii) to produce a diffused plasma 51 and required ions are extracted from the diffused plasma 51 into a low pressure ($10^{-3}$ to $10^{-7}$ Torr) region (iii) by use of an ion extraction electrode 110 and an ion acceleration electrode 120.

According to a second aspect of the present invention for achieving the above-mentioned second object, as shown in FIG. 4, an angle $\theta$ ($0<\theta\leqq 90°$) is established between the center axis a-b of an ion generation or high pressure region (i) and the center axis c-d of ion extraction regions (ii) and (iii), thereby effectively suppressing (or preventing) the deterioration of S/N ratio which may be caused by photons from the plasma, etc.

With the construction according to the above first aspect of the present invention, an ion sheath 130 is formed at the boundary between the ion extraction electrode 110 and the diffused plasma 51. Thereby, the required ions can be effectively extracted from the plasma 51 instead of extracting ions from a supersonic viscous flow of plasma gas through the aperture 71 of the skimmer 70 in the conventional plasma source mass spectrometer. Namely, the shape of the ion sheath 130 formed in the vicinity of an aperture (or ion extraction opening) 111 provided in the ion extraction electrode 110 is optimized by a voltage (or ion extraction voltage) $V_E$ applied between the ion extraction electrode 110 and the ion acceleration electrode 120 so as to provide a convex-shaped sheath protruding toward the diffused plasma 51, so that ions extracted from the diffused plasma 51 are focused by virtue of the convex-shaped ion sheath. The current density J of ions extracted follows a relation of $J\alpha V_E^n$ ($n>1$) as indicated by curve A shown in FIG. 3 and can have a larger value a compared with the ion current density in the conventional plasma source mass spectrometer following such a saturation characteristic ($J\alpha V_E^{\frac{1}{2}}$) as indicated by curve B shown in FIG. 3. Also, the ion current density J can be easily controlled by changing the ion extraction voltage $V_E$.

With the construction according to the above mentioned second aspect of the present invention, since the amount of light travelling from the plasma 50 generated in the high pressure region (i) toward the mass analyser side, it is possible to reduce the amount of photons entering into the mass analyser side thereby improving the S/N ratio in measurement. Also, since no provision of the photon stopper 100 in the conventional plasma source mass spectrometer is required, it is possible to make the construction of an ion lens system simple and it is possible to introduce required ions into the mass analyser side with an increased efficiency.

The other objects of the present invention, characteristic constructions for attainment of the objects, and functions and effects provided by the constructions will become apparent from the description of the present invention which will be made hereinbelow in conjunction with embodiments thereof.

DESCRIPTION OF THE PREFERRED EMBODIMENTS

Embodiments of the present invention will now be explained in detail with reference to the accompanying drawings.

Figure 1:
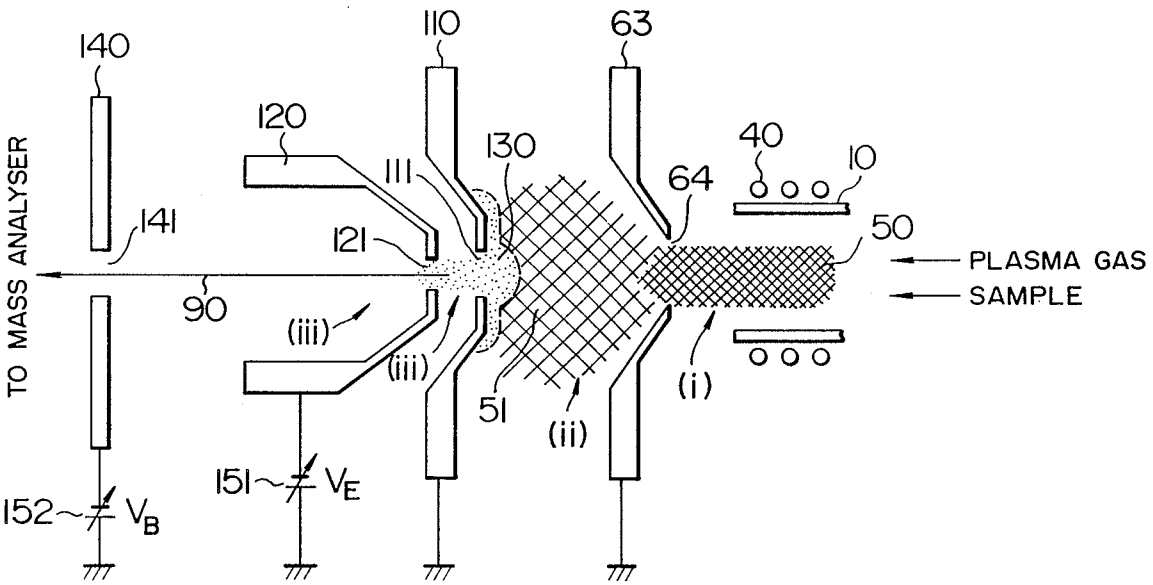
FIG. 1 is a view showing the basic construction of a main part of an atmospheric pressure plasma source mass spectrometer according to an embodiment of the present invention.
Figure 2A:
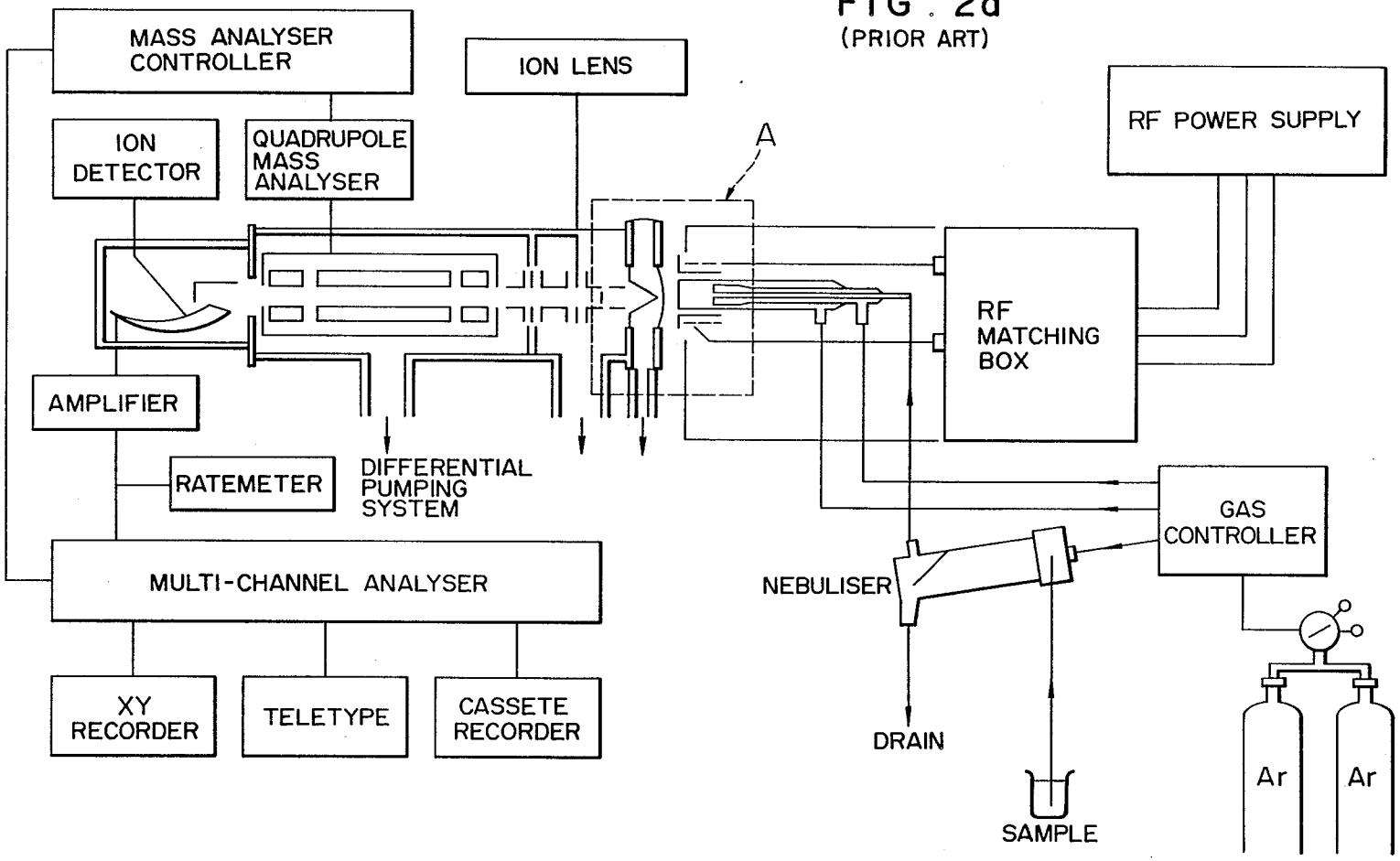
FIG. 2a (PRIOR ART)
FIG. 2*a* is a view showing the construction of the conventional atmospheric pressure plasma source mass spectrometer.
Figure 2B:
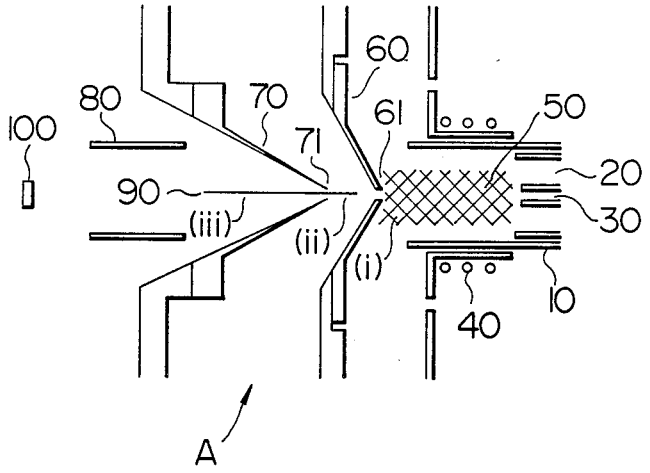
FIG. 2b (PRIOR ART)
FIG. 2*b* is a view showing the details of a portion A in FIG. 2*a*.
Figure 3:
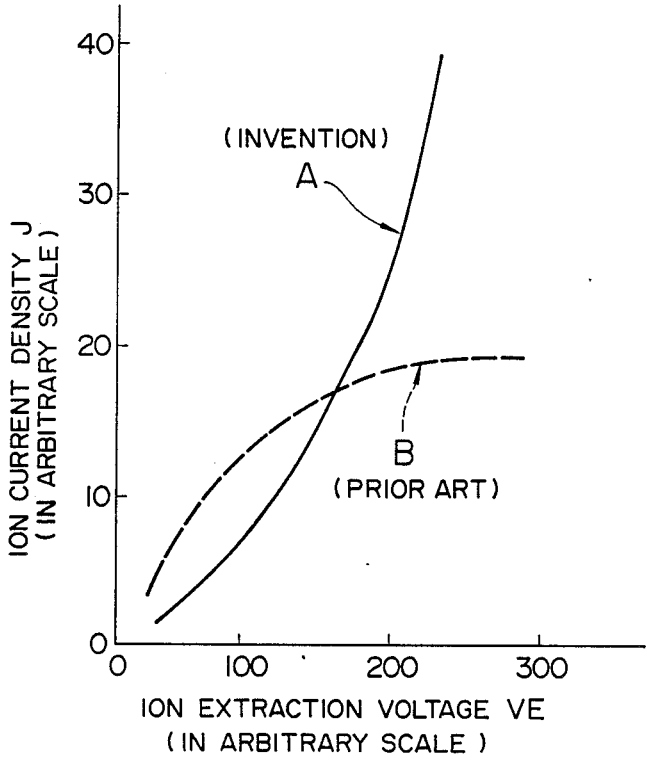
FIG. 3 is a graph comparatively showing the ion extraction voltage ($V_E$) versus ion current density (J) characteristic of an ion extraction system according to the present invention and the $V_E$ versus J characteristic according to the prior art.

FIG. 1 is a view showing the construction of a main part of a plasma source mass spectrometer according to an embodiment of the present invention. (FIG. 1 corresponds to FIG. 2*b* or the portion A in FIG. 2*a*.) In FIG. 1, reference numeral 10 designates a discharge tube made of quartz or the like, numeral 40 a high frequency (including micro-waves) power supply (such as coil or oscillator), numeral 50 a high pressure plasma generated in a high pressure (760 to 1 Torr) region (i), numeral 51 a diffused plasma produced by diffusing (or expanding) the high pressure plasma 50 into a moderate pressure (1 to $10^{-3}$ Torr) region (ii), numeral 63 a plasma sampling electrode made of stainless steel or the like and cooled (for example, in a water cooling manner), numeral 64 a plasma sampling opening provided in the plasma sampling electrode 63 (for example, a circular opening having a diameter not greater than about 1.0 mmϕ), numeral 110 an ion extraction electrode made of nickel or the like and cooled (for example, in a water cooling manner), numeral 111 an ion extraction opening provided in the ion extraction electrode 110 (for example, a circular opening a diameter $x_1$ of 1–0.5 mmΦ and a thickness (or an electrode thickness at the opening) $l_1$ of 0.5 to 1 mm), numeral 120 an ion acceleration electrode made of stainless steel or the like, numeral 121 an ion acceleration opening provided in the ion acceleration electrode 120 (for example, a circular opening having a diameter $x_2$ of about 0.4–0.8 mmΦ and a thickness (or an electrode thickness at the opening) $l_2$ of 0.5 to 2 mm), numeral 130 an ion sheath formed in the vicinity of the opening 111 of the ion extraction electrode 110, and numeral 140 an ion energy control electrode made of stainless steel or the like and having an orifice 141 provided at a central portion thereof. Numeral 90 designates an ion beam extracted. It is preferable that the opening diameters $x_1$ and $x_2$ and the electrode thicknesses $l_1$ and $l_2$ satisfy a relation of $x_1/x_2 \approx 5\ l_1/l_2 + 0.8$. Also, it is preferable that the length l of a gap between the ion extraction electrode 110 and the ion acceleration electrode 120 is established to satisfy a relation of $l:x_2:x_1 \approx 1:2:3$. Numeral 151 designates an ion extraction voltage source for applying an ion extraction voltage $V_E$ (<0) between the ion extraction electrode 110 and the ion acceleration electrode 120, and numeral 152 designates an ion energy control voltage source for applying an ion energy control voltage $V_B$ ($\gtreqless 0$) to the ion energy control electrode 140.

The operation of the plasma source mass spectrometer having the above-mentioned construction is as follows. A sample and a plasma gas (He, $N_2$, Ar or the like) introduced into the discharge tube 10 in the high pressure region (i) are dissociated and ionized by the action of a high frequency power supplied by the high frequency power supply 40 so that a high pressure plasma 50 is generated. The generated high pressure plasma 50 is diffused through the plasma sampling opening 64 into a differentially pumped moderate pressure (1 to $10^{-3}$ Torr) region (ii) so that a diffused plasma 51 is produced. When an ion extraction voltage $V_E$ is applied between the ion extraction electrode 110, which is disposed in the rear of the plasma sampling electrode 63 at a position distanced therefrom by about 3 to 20 mm (toward a direction of diffusion of the plasma) and normally grounded, and the ion acceleration electrode 120 which is disposed in the rear of the ion extraction electrode 110, a convex-shaped ion sheath 130 protruding toward the diffused plasma 51 is formed in the vicinity of the ion extraction opening 111 so that ions extracted from the boundary between the diffused plasma 51 and the ion sheath 130 are focused by a lens action of the convex-shaped ion sheath 130 and are accelerated through the ion acceleration opening 121 with an energy $eV_E$, thereby forming an ion beam 90. When a potential $V_B$ is applied to the ion energy control electrode 140, the energy of the ion beam 90 can be ultimately controlled to $eV_B$. The ion beam 90 having an energy of $eV_B$ is introduced into a mass analyser (for example, of a quadrupole type) provided in a low pressure ($10^{-3}$ to $10^{-7}$ Torr) region (iii) and is mass-analyzed. Thereby, quantitative analysis of elements of the sample can be made with a high sensitivity. An ion lens system such as an Einzel lens may be preferably provided between the ion acceleration electrode 120 and the ion energy control electrode 140 or between the ion energy control electrode 140 and the mass analyser in order to minimize the divergence of the ion beam.

Figure 4:
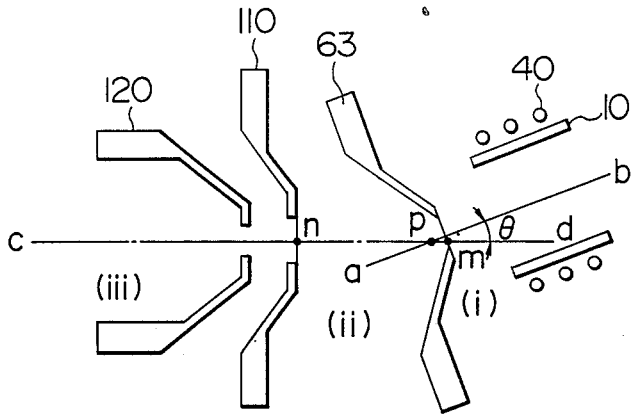
FIG. 4 is a schematic view of an atmospheric pressure plasma source mass spectrometer according to another embodiment of the present invention.

In the case where the deterioration of S/N ratio due to noise (background noise) caused by photons from the high pressure plasma 50 is called to account, there can be employed a construction as shown in FIG. 4 which shows another embodiment of the present invention. Namely, the high pressure plasma generation portion (including the discharge tube 10, the high frequency power supply 40, etc.) and the plasma sampling electrode 63 are disposed inclined relative to the ion extraction system (including the ion extraction electrode 110, the ion acceleration electrode 120, etc.) provided therebehind so that an angle $\theta$ satisfying $0 < \theta \leqq 90°$ is established between the center axis a-b of the high pressure plasma 50 and the center axis c-d of the ion extraction system. The intersection p of the center axes a-b and c-d is established to be placed between the intersection m of a surface of the plasma sampling electrode 63 on the plasma 50 side and the center axis c-d and the intersection n of a surface of the ion extraction electrode 110 on the plasma 50 side and the center axis c-d ($m \leqq p \leqq n$), as shown in FIG. 4. It is not always required to incline the ion sampling electrode 63 relative to the ion extraction electrode 110. The plasma sampling electrode 63 may be parallel to the ion extraction electrode 110.

With such a construction in which the center axis a-b of the high pressure plasma 50 and the center axis c-d of the ion extraction system are inclined relative to each other, it is possible to prevent interfering particles such as photons emitted from the high pressure plasma 50 from entering together with the sample ion beam into the mass analyser, thereby improving the S/N ratio in analysis.

Figure 5:
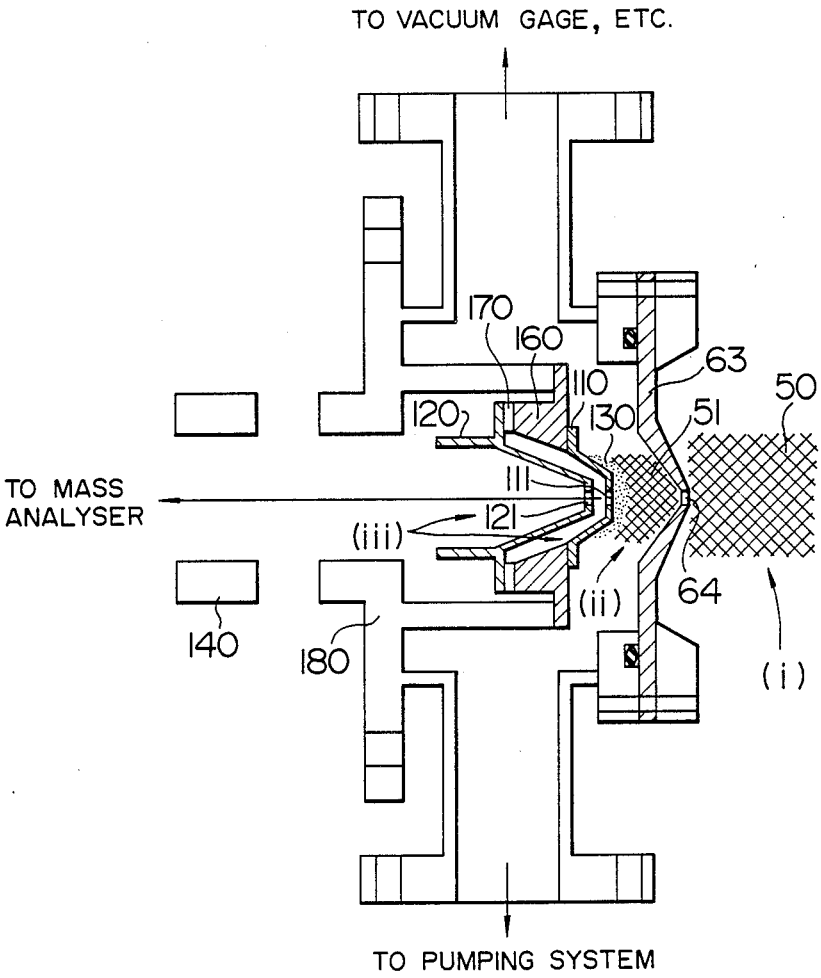
FIG. 5 is a view showing the construction of an atmospheric pressure plasma source mass spectrometer according to a further embodiment of the present invention.

FIG. 5 shows a further embodiment of the present invention. The present embodiment is characterized by a structure in which the ion extraction electrode 110 and the ion acceleration electrode 120 are supported by the same supporting substrate 160 in order to improve the accuracy of setting of axis for the ion extraction opening 111 of the ion extraction electrode 110 and the ion acceleration opening 121 of the ion acceleration electrode 120, the accuracy of gap dimension between the electrodes 110 and 120 and the degree of parallelization of the electrodes 110 and 120 to each other.

More particularly, as shown in FIG. 5, the ion extraction electrode 110 and the ion acceleration electrode are attached to opposite surfaces of the common supporting substrate 160 made of, for example, brass with a high accuracy of dimension with the center axis of the ion extraction opening 111 and the ion acceleration opening 121 being set so as to coincide with each other with a high accuracy. For the purpose of applying the above-mentioned ion extraction voltage $V_E$ to the ion acceleration electrode 120, an insulating spacer 170 is interposed between the ion acceleration electrode 120 and the supporting substrate 160. Electrical short-circuit between the ion extraction electrode 110 and the ion acceleration electrode 120 is prevented by the insulating spacer 170. After the electrodes 110 and 120 have thus been attached to the common supporting substrate 160 with a high accuracy, the supporting substrate 160 is attached to a substrate holding frame 180.

Figure 6:
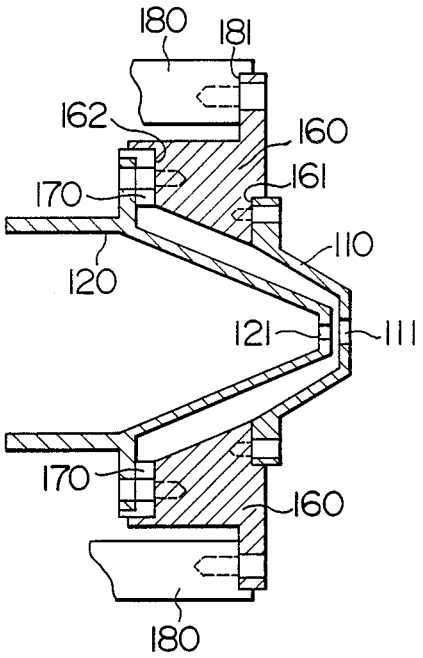
FIG. 6 is a view showing the construction of an atmospheric pressure plasma source mass spectrometer according to a still further embodiment of the present invention.

FIG. 6 shows a still further embodiment of the present invention. The present embodiment is characterized in that setting recesses for facilitating the setting of the ion extraction electrode 110 and the ion acceleration electrode 120 are provided in the opposite surfaces of the common supporting substrate 160, respectively. More particularly, a circular setting recess 161 for setting the ion extraction electrode 110 is provided in one of the opposite surfaces of the supporting substrate 160 and a circular setting recess 162 for setting the ion acceleration electrode 120 is provided in the other surface of the supporting substrate 160. The electrodes 110 and 120 are inserted into the setting recesses 161 and 162, respectively. If the setting recesses 161 and 162 are concentrically formed, the setting of the center axis of the ion extraction opening 111 and the ion acceleration opening 121 can be further facilitated. With such a construction, the setting of the electrodes 110 and 120 can be attained with a good reproducibility even when electrodes are attached again after exchange or cleaning of electrodes.

It is further convenient to provide a setting recess 181 in a surface of the substrate holding frame 180 so that the outer periphery of the supporting substrate 160 is inserted into the setting recess 181.

The present invention is not limited to shapes and dimensions of various electrodes disclosed and shown in conjunction with the embodiments. Also, the method of generating the high pressure plasma 50 is not limited to one disclosed and shown in conjunction with the embodiments. For example, a corona discharge using a DC power supply may be used. Further, even if the ground potential level of the electrodes 63, 110 and the negative potential level of the electrode 120 shown in FIG. 1 are changed to a positive potential level and a ground potential level, respectively, the system makes a similar operation. Furthermore, if the high pressure region (i) operates under a pressure sufficiently lower than the atmospheric pressure, the plasma sampling electrode 63 may be omitted.

As apparent from the foregoing, according to the present invention, since an ion sheath is formed, there is provided an effect that sample ions can be effectively extracted under the control of the ion extraction voltage $V_E$, thereby enhancing the sensitivity of the system (or lowering the detection limit).

Also, an angle $\theta$ ($0<\theta\leqq 90°$) may be established between the center axis a-b of a plasma generation region and the center axis c-d of an ion extraction region. Thereby, there is provided an effect that the deterioration of S/N ratio caused by photons, etc. can be suppressed.

Further, to control the potential $V_B$ of the ion energy control electrode 140 provides an effect that the energy of an ion beam entering into the mass analyser can be controlled freely.

We claim:

1. A plasma source mass spectrometer comprising at least:

plasma generation means for generating a plasma in a high pressure region;

diffusion means including a plasma sampling electrode having a plasma sampling opening through which the plasma generated in the high pressure region is diffused into a moderate pressure region to produce a diffused plasma; and ion extraction means for extracting ions from the diffused plasma, said ion extraction means including an ion extraction electrode for forming an ion sheath and an ion acceleration electrode.

2. A plasma source mass spectrometer according to claim 1, wherein an angle $\theta$ satisfying $0<\theta\leqq 90°$ is established between the center axis of said plasma generation means and the center axis of said ion extraction means.

3. A plasma source mass spectrometer, according to claim 1, further comprising an ion energy control electrode provided in the rear of said ion acceleration electrode in a direction of travel of ions, said ion energy control electrode having an orifice for passing the ions therethrough, and a bias voltage $V_B$ applied to said ion energy control electrode.

4. A plasma source mass spectrometer, according to claim 2, further comprising an ion energy control electrode provided in the rear of said ion acceleration electrode in a direction of travel of ions, said ion energy control electrode having an orifice for passing the ions therethrough, and a bias voltage $V_B$ applied to said ion energy control electrode.

5. A plasma source mass spectrometer according to claim 1, wherein each of said plasma sampling electrode and said ion extraction electrode is grounded while said ion acceleration electrode is connected to a negative potential.

6. A plasma source mass spectrometer according to claim 2, wherein each of said plasma sampling electrode and said ion extraction electrode is grounded while said ion acceleration electrode is connected to a negative potential.

7. A plasma source mass spectrometer according to claim 1, wherein each of said plasma sampling electrode and said ion extraction electrode is connected to a positive potential while said ion acceleration electrode is grounded.

8. A plasma source mass spectrometer according to claim 2, wherein each of said plasma sampling electrode and said ion extraction electrode is connected to a positive potential while said ion acceleration electrode is grounded.

9. A plasma source mass spectrometer according to claim 1, further comprising a lens system provided in the rear of said ion acceleration electrode in a direction of travel of ions for focusing the ions.

10. A plasma source mass spectrometer according to claim 2, further comprising a lens system provided in the rear of said ion acceleration electrode in a direction of travel of ions for focusing the ions.

11. A plasma source mass spectrometer according to claim 1, wherein said ion extraction electrode and said ion acceleration electrode are attached to the same supporting substrate.

12. A plasma source mass spectrometer according to claim 2, wherein said ion extraction electrode and said ion acceleration electrode are attached to the same supporting substrate.

13. A plasma source mass spectrometer according to claim 11, wherein setting recesses for setting said ion extraction electrode and said ion acceleration electrode are provided in said supporting substrate and said ion extraction electrode and said ion acceleration electrodes are inserted into said recesses.

14. A plasma source mass spectrometer according to claim 12, wherein setting recesses for setting said ion extraction electrode and said ion acceleration electrode are provided in said supporting substrate and said ion extraction electrode and said ion acceleration electrodes are inserted into said recesses.

* * * * *